US005599357A

United States Patent [19]

Leeper

[11] Patent Number: 5,599,357

[45] Date of Patent: Feb. 4, 1997

[54] METHOD OF OPERATING A REFINERY TO REDUCE ATMOSPHERIC POLLUTION

[75] Inventor: Thomas A. Leeper, Baton Rouge, La.

[73] Assignee: Ehtyl Corporation, Richmond, Va.

[21] Appl. No.: 434,614

[22] Filed: May 4, 1995

Related U.S. Application Data

[63] Continuation of Ser. No. 749,101, Aug. 23, 1991, abandoned, which is a continuation-in-part of Ser. No. 552,090, Jul. 13, 1990, abandoned.

[51] Int. Cl.[6] ..... C10L 1/18

[52] U.S. Cl. ..... 44/355; 44/360

[58] Field of Search ..... 44/355, 360

[56] References Cited

U.S. PATENT DOCUMENTS

| | | | |
|---|---|---|---|
| 2,178,403 | 10/1939 | Muskat | 44/9 |
| 2,818,416 | 12/1957 | Brown et al. | 260/429 |
| 2,818,417 | 12/1957 | Brown et al. | 260/429 |
| 2,868,816 | 1/1959 | Petree | 260/429 |
| 3,127,351 | 3/1964 | Brown et al. | 252/49.7 |
| 4,082,517 | 4/1978 | Niebylski et al. | 44/359 |
| 4,139,349 | 2/1979 | Payne | 44/359 |
| 4,140,491 | 2/1979 | Allain | 44/56 |
| 4,175,927 | 11/1979 | Niebylski et al. | 44/359 |
| 4,191,536 | 3/1980 | Niebylski et al. | 44/360 |
| 4,207,078 | 6/1980 | Sweeney et al. | 44/68 |
| 4,244,704 | 1/1981 | Sweeney et al. | 44/78 |
| 4,390,345 | 6/1983 | Somorjai | 44/63 |
| 4,437,436 | 3/1984 | Graiff et al. | 44/360 |
| 4,508,618 | 4/1985 | Olah | 208/134 |
| 4,674,447 | 6/1987 | Davis | 44/359 |

FOREIGN PATENT DOCUMENTS 8701384 3/1987 WIPO .

OTHER PUBLICATIONS

Faggan, et al., "An Evaluation of Manganese as an Anti-knock in Unleaded Gasoline," *SAE Automobile Engineering Meeting*, Detroit, Mich., Oct. 13–17, 1975.

Lowi, et al., "A Method for Evaluating the Atmospheric Ozone Impact of Actual Vehicle Emissions", SAE International Congress & Exposition, Detroit, Mich., Feb. 26–Mar. 02, 1990.

Leeper, et al., "*HITEC 3000—An Octane Additive for the Future*", 1990 NPRA Annual Meeting, San Antonio, Texas, Mar. 25–27, 1990.

*Primary Examiner*—Jacqueline V. Howard
*Attorney, Agent, or Firm*—Dennis H. Rainear

[57] ABSTRACT

Methods and compositions for reducing toxic compounds emissions and the maximum reactivity of exhaust products emitted by spark-ignition internal combustion engines. Gasoline having a minimum target octane number is formed by blending together base fuel blending components and at least one cyclopentadienyl manganese tricarbonyl compound in an amount equivalent to up to about 0.03 gram of manganese per gallon. The manganese compound is used in lieu of an amount of one or more aromatic gasoline hydrocarbons required to achieve the same target octane number so that there is a more than proportionate decrease in toxic aromatic compounds in the tailpipe exhaust and the maximum reactivity of the tailpipe exhaust products produced by the manganese-containing gasoline is less than the maximum reactivity of the tailpipe exhaust products produced by the same base fuel blending components not containing any such manganese compound but containing in lieu thereof an amount of one or more aromatic gasoline hydrocarbons required to achieve the same target octane number. There is thus provided a way of providing and using gasolines of suitable octane values while concomitantly reducing toxic compound emissions and the potential for ground ozone formation, smog formation, and other grievous consequences of atmospheric pollution.

16 Claims, 2 Drawing Sheets

METHOD OF OPERATING A REFINERY TO REDUCE ATMOSPHERIC POLLUTION

This application is a continuation of application Ser. No. 07/749,101, filed Aug. 23, 1991, which in turn is a continuation-in-part of application Ser. No. 07/552,090, file Jul. 13, 1990, both now abandoned.

TECHNICAL FIELD

This invention relates to fuels for gasoline engines and more particularly to gasoline fuels having superior environmental and performance properties.

BACKGROUND

Recent studies of EPA regulations provide guidelines for reformulated gasolines which will provide a reduction in toxic compounds, eg. benzene, butadiene, formaldehyde, and acetaldehyde in the tailpipe exhaust gases from automobiles. The attainment of lower toxic emissions is not without penalty. Generally, the target octane number must be lowered and refinery capacity must be adjusted to obtain these lower toxic emissions. These solutions are not completely acceptable due to the higher octane requirement of today's automobile engines and the need to conserve crude oil resources. In addition to a reduction in toxic compounds in the tailpipe exhaust products, recent studies indicate that ozone formation in the atmosphere is a function of the reactivity of individual species of organic compounds present in exhaust emissions from spark-ignition internal combustion engines, as well as the quantity of nitrogen oxides ($NO_x$) emitted from the engines. In particular, a factor deemed of prime importance in the formation of ground level ozone is the maximum reactivity of hydrocarbons and other organic species emitted as exhaust products by gasoline engines. Maximum reactivity is a function of the quantity of given species of emitted exhaust products and the maximum reactivity values or constants for such species. Thus the higher the maximum reactivity (which is directly proportional to species quantity multiplied by the maximum reactivity value for such species), the greater the danger of ground level ozone formation. It is thus of paramount importance to reduce the maximum reactivity of the exhaust products emitted by spark-ignition internal combustion engines, such as passenger cars, buses, trucks, vans, motorcycles, and the like, as well as reducing the total $NO_x$ emissions from such sources. By so doing, it is generally accepted by the scientific community that the extent of smog formation and other dire consequences of atmospheric pollution will be substantially reduced. The atmospheric contaminants needed to produce ozone smog are (1) reactive volatile organic compounds, (2) nitrogen oxides, and (3) sunlight. Note for example, Lowi, Jr. and Carter, "A Method for Evaluating the Atmospheric Ozone Impact of Actual Vehicle Emissions", SAE Paper No. 900710, presented at the 1990 SAE International Congress & Exposition, Detroit, Mich., Feb. 26–Mar. 2, 1990.

Complicating the foregoing problem is the need to provide gasoline fuel compositions which satisfy the demands imposed upon the fuels by the engines in which they are employed. The fuels must have the octane quality, volatility, stability, distillation characteristics, and the like, required for effective use as motor fuels. Of these, achievement of the requisite octane value is perhaps of greatest importance from both the performance and environmental standpoints. In addition, these key gasoline properties must be provided on an economical basis and without excessively or prematurely depleting natural resources such as the world's supply of petroleum. Moreover, these key gasoline properties must be provided within the capabilities and production capacities of the petroleum refining industry.

This invention is believed to provide a highly efficacious way of reducing the amount of toxic compounds and maximum reactivity of exhaust products emitted by spark-ignition internal combustion engines, as well as reducing the total $NO_x$ emissions. In addition, this invention is deemed to provide a most effective and efficient way of providing and using gasolines of suitable octane values while concomitantly reducing the potential for ground ozone formation, smog formation, and other grievous consequences of atmospheric pollution. Accordingly, this invention is believed to provide an increase in refinery capacity and a decrease in refinery emissions by providing an efficacious means for formulating gasoline with a target octane number.

SUMMARY OF THE INVENTION

In one of its embodiments this invention provides a process of formulating gasoline having a minimum target octane number, which process comprises achieving such target octane number by blending together base fuel blending components of the gasoline boiling range and at least one cyclopentadienyl manganese tricarbonyl compound in an amount equivalent to up to about 0.03 gram of manganese per gallon, said amount of such cyclopentadienyl manganese tricarbonyl compound(s) being used in lieu of an amount of one or more aromatic gasoline hydrocarbons required to achieve the same target octane number, whereby there is more than a proportionate decrease in toxic aromatic compounds in the tailpipe exhaust products, and whereby the maximum reactivity of the tailpipe exhaust products produced by the manganese-containing formulated gasoline is less than the maximum reactivity of the tailpipe exhaust products produced by the same base fuel blending components not containing any cyclopentadienyl manganese tricarbonyl compound but containing in lieu thereof an amount of one or more aromatic gasoline hydrocarbons required to achieve the same target octane number, and whereby the emissions of nitrogen oxide compounds are reduced.

Another embodiment of this invention provides a gasoline having a preselected target octane number, which comprises (i) a predominantly hydrocarbonaceous blend of base fuel blending components of the gasoline boiling range and (ii) at least one cyclopentadienyl manganese tricarbonyl compound in an amount equivalent to up to about 0.03 gram of manganese per gallon, such amount of such cyclopentadienyl manganese tricarbonyl compound(s) being used in lieu of an amount of one or more aromatic gasoline hydrocarbons required to achieve the same target octane number, whereby there is more than a proportionate decrease in toxic aromatic compounds in the tailpipe exhaust products and whereby the NOx, CO, and the maximum reactivity of the tailpipe exhaust products resulting from use of such gasoline in a spark ignition internal combustion engine is less than the maximum reactivity of the tailpipe exhaust products resulting from use in such engine of a gasoline consisting of component (i) additionally containing an amount of one or more aromatic gasoline hydrocarbons required to achieve the same target octane number.

A further embodiment of this invention relates to a process of operating a spark-ignition internal combustion engine which uses a gasoline fuel of suitable octane quality, which process comprises using as the gasoline fuel for said engine a formulated gasoline of suitable octane quality which comprises (i) a plurality of hydrocarbons of the gasoline boiling range and (ii) at least one cyclopentadienyl manganese tricarbonyl compound in an amount equivalent to up to about 0.03 gram of manganese per gallon, said amount of such cyclopentadienyl manganese tricarbonyl compound(s) being used in lieu of an amount of one or more aromatic gasoline hydrocarbons required to achieve the same octane quality, whereby there is more than a proportionate decrease in toxic aromatic compound(s) in the tailpipe exhaust products and whereby the maximum reactivity of the tailpipe exhaust products and the $NO_x$ and CO emissions products resulting from use of such formulated gasoline in said engine is less than the maximum reactivity of the tailpipe exhaust products resulting from use in said engine of a gasoline consisting of component (i) additionally containing an amount of one or more aromatic gasoline hydrocarbons required to achieve the same octane quality.

In yet another embodiment, this invention provides a process for operating a refinery having a rated crude capacity of more than about 50,000 barrels per stream day (MBPSD) and wherein at least about 45% of the rated capacity is utilized in the production of gasoline, which process comprises formulating gasoline to a target octane number by blending together base fuel blending components of the gasoline boiling range and at least one cyclopentadienyl manganese tricarbonyl compound in an amount equivalent up to about 30 kilograms (kg) of manganese per 23,000 barrels of formulated gasoline per stream day (MBPSD) whereby there is a reduction in refinery furnace emissions of $NO_x$, CO particulates, $SO_x$, and $CO_2$, and whereby there is a reduction in toxic compounds, in reactive organic compounds, and in $NO_x$ compounds in the tailpipe exhaust products produced by the use of such formulated gasoline in an internal combustion engine as compared to a formulated gasoline of said base fuel blending components and additionally containing an amount of one or more aromatic gasoline hydrocarbons required to achieve the same octane quality, but which formulated gasoline does not contain said cyclopentadienyl manganese tricarbonyl compound.

Other embodiments and features of this invention will become apparent from the ensuing description and appended claims.

THE DRAWINGS

DESCRIPTION OF PREFERRED EMBODIMENTS

Figure 1:
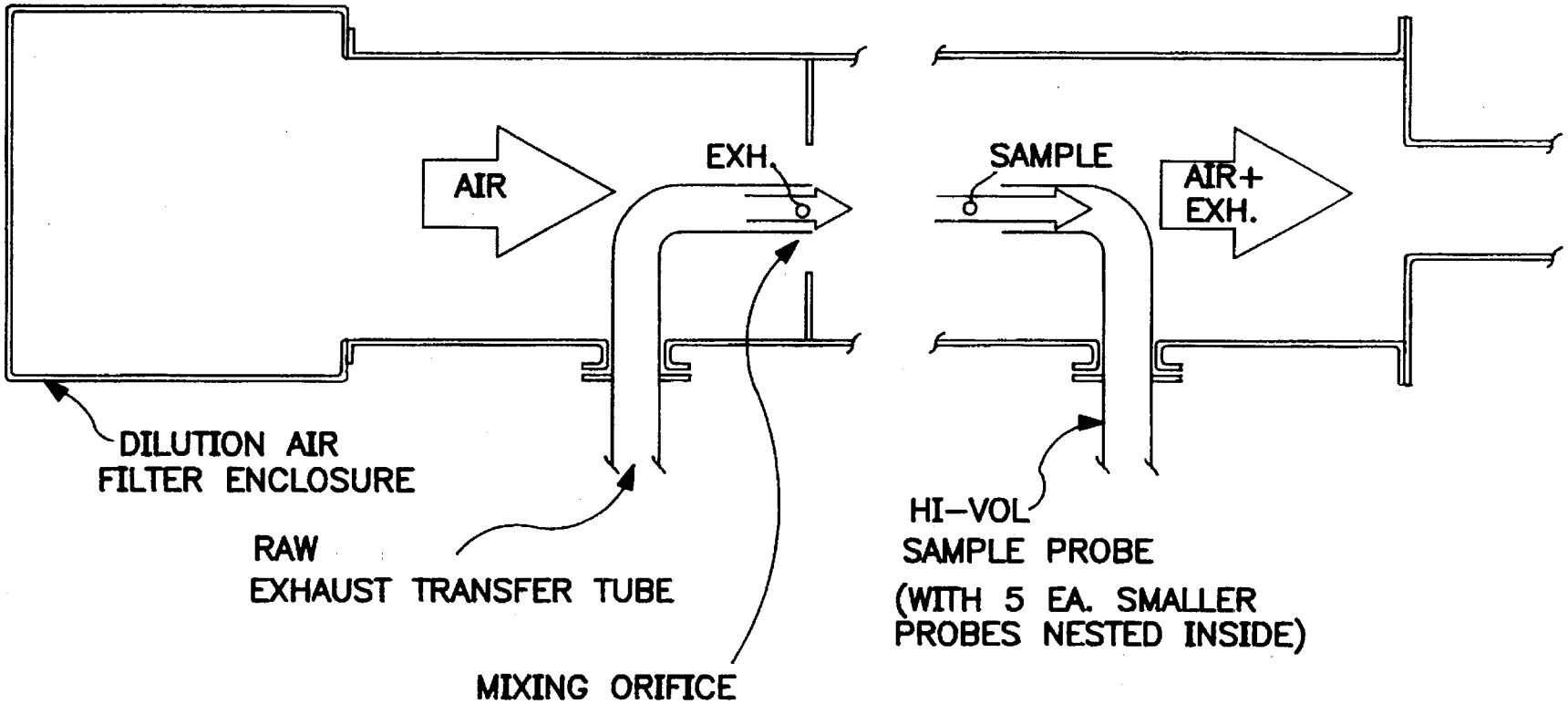
FIG. 1 is a dimensional schematic representation of the exhaust dilution tunnel utilized in the tests described in Examples 1–4 hereinafter.

In each of the embodiments summarized above, the gasoline-type hydrocarbon fuels used in forming the gasoline will generally comprise saturates, olefins and aromatics. Oxygenated fuel blending components, such as hydrocarbyl ethers, are also suitable for use in the various fuels of the above embodiments. In other preferred embodiments of this invention, the fuels contain limitations on the content of aromatic gasoline hydrocarbons, inasmuch as aromatics are capable of providing exhaust product species of relatively high reactivity. Likewise, it is desirable to form or utilize in gasolines containing at most relatively small quantities of olefinic hydrocarbons (e.g., less than 10%, and more preferably less than 5% by volume), as these substances tend to produce exhaust product species of high reactivity.

At the present time the most widely used method of increasing the octane quality of pool gasoline is to utilize aromatic gasoline hydrocarbons in the base blends. This results from the fact that existing refining capacity is biased toward production of highly aromatic gasolines in order to satisfy the octane demands imposed upon them by the high performance vehicles desired and used by the motoring public. Unfortunately however, certain aromatic hydrocarbons, such as benzene, are regarded as carcinogens. Moreover, and as noted above, aromatic hydrocarbons (and also olefinic hydrocarbons) tend to produce exhaust products containing relatively reactive species which are deemed to participate in the formation of ground level ozone, smog, and other forms of atmospheric pollution.

This invention overcomes this dilemma by utilizing an antiknock compound of such potency that as little as 0.03 of a gram or less per gallon of manganese in the fuel gives rise to significant increases in octane quality. Thus the refiner is able to provide a gasoline having the desired octane quality while at the same time maintaining or even reducing the quantity of aromatics in the base fuel. As a consequence, the hydrocarbon tailpipe emissions resulting from use of the fuels of this invention have lower emissions of toxic compounds and lower maximum reactivity than the hydrocarbon emissions of the same fuel would have if the antiknock agent were replaced by an amount of aromatic hydrocarbons necessary to achieve the same octane quality. Indeed, in at least some instances the fuels of this invention produce hydrocarbon emissions having substantially lower total toxic compounds and lower total maximum reactivities than the hydrocarbon emissions from the same base fuel devoid of the cyclopentadienyl manganese tricarbonyl additive(s). This especially preferred embodiment of the invention is illustrated in Example 4 hereinafter.

Another benefit of the process of this invention is the ability of a refiner to decrease the severity of reformer operations in the production of gasoline. The reduction in reformer severity is due in part to the obtainment of the target octane numbers by using an amount of at least one cyclopentadienyl manganese tricarbonyl compound in lieu of an amount of one or more aromatic gasoline hydrocarbons required to achieve the same target octane number. By reducing the severity of the reformer operation, a refiner is able to decrease the amount of fuel oil required for reformer operation—which in turn results in a decrease in the amount of emissions of $NO_x$, CO, particulates, $SO_x$, and $CO_2$ from the reformer furnace stack. Accordingly, the use of at least one cyclopentadienyl manganese tricarbonyl compound in lieu of an amount of aromatic gasoline hydrocarbons to achieve the same target octane number thus provides reduced refinery emissions as well as a reduction in automobile toxic emissions.

To achieve the same target octane number in refinery formulated gasoline, a refinery having a rated crude capacity of about 50,000 barrels per stream day (MBPSD), wherein about 45% of the rated capacity is utilized in the production of gasoline, will use at least one cyclopentadienyl manganese tricarbonyl compound in an amount equivalent to from about 10 to about 40 kg of manganese per stream day, preferably up to about 15 to about 35 kg of manganese per stream day, and most preferably up to about 25 to about 30 kg of manganese per stream day.

Moreover, in accordance with preferred embodiments of this invention, the amount of olefinic hydrocarbons in the fuel composition can be controlled so as to be less than about 10% by volume (preferably less than 5% by volume) and, in addition, oxygenated fuel-blending components (e.g., hydrocarbyl ethers) of suitable distillation characteristics can be included in the fuel. In order to still further improve the fuel compositions from the environmental standpoint, the fuel composition should be blended from components such that the Reid vapor pressure (ASTM test method D-323) is 9.0 psi or less and most preferably 8.0 psi or less. In this way the evaporative losses of the fuel into the atmosphere during storage and fueling operations can be effectively reduced. As is well known, Reid vapor pressures are determined at 100° F. (37.8° C.).

The gasolines of this invention are lead-free in the sense that no organolead antiknock agent is blended into the fuel. If any trace amounts of lead are present, such amounts are due exclusively to contamination in the system in which the fuels are formed, blended, stored, transported or dispensed.

The hydrocarbonaceous gasoline base stocks that can be used in forming the gasoline blends include straight run stocks, light naphtha fractions, cracked gasoline stocks obtained from thermal or catalytic cracking, hydrocracking, or similar methods, reformate obtained by catalytic reformation or like processes, polymer gasolines formed via polymerization of olefins, alkylates obtained by addition of olefins to isobutane or other hydrocarbons by alkylation processes, isomerates formed by isomerization of lower straight chain paraffins such as a n-hexane, n-heptane, and the like, and other hydrocarbons of the gasoline boiling range formed by suitable refinery processing operations. Suitable amounts of appropriate hydrocarbons formed by other methods such as production from coal, shale or tar sands can be included, if desired. For example reformates based on liquid fuels formed by the Fischer-Tropsch process can be included in the blends. In all cases however, the resultant gasoline must satisfy the reduced total toxic compounds and the maximum reactivity tailpipe hydrocarbon emission requirements of this invention and additionally will possess the distillation characteristics typical of conventional regular, midgrade, premium, or super-premium unleaded gasolines. For example, the motor gasolines are generally within the parameters of ASTM D 4814 and typically have initial boiling points in the range of about 20 to about 46° C. and final boiling points in the range of about 185° to about 225° C. as measured by the standard ASTM distillation procedure (ASTM D 86). The hydrocarbon composition of gasolines according to volume percentages of saturates, olefins, and aromatics is typically determined by ASTM test procedure D 1319.

Generally, the base gasoline will be a blend of stocks obtained from several refinery processes. The final blend may also contain hydrocarbons made by other procedures such as alkylates made by the reaction of $C_4$ olefins and butanes using an acid catalyst such as sulfuric acid or hydrofluoric acid, and aromatics made from a reformer.

The saturated gasoline components comprise paraffins and naphthenates. These saturates are generally obtained from: (1) virgin crude oil by distillation (straight run gasoline), (2) alkylation processes (alkylates), and (3) isomerization procedures (conversion of normal paraffins to branched chain paraffins of greater octane quality). Saturated gasoline components also occur in so-called natural gasolines. In addition to the foregoing, thermally cracked stocks, catalytically cracked stocks and catalytic reformates contain some quantities of saturated components. In accordance with preferred embodiments of this invention, the base gasoline blend contains a major proportion of saturated gasoline components. Generally speaking, the higher the content of saturates consistent with producing a fuel of requisite octane quality and distillation characteristics, the better.

Olefinic gasoline components are usually formed by use of such procedures as thermal cracking, and catalytic cracking. Dehydrogenation of paraffins to olefins can supplement the gaseous olefins occurring in the refinery to produce feed material for either polymerization or alkylation processes. In order to achieve the greatest octane response to the addition of the cyclopentadienyl manganese tricarbonyl antiknock compound, the olefins, if used in the fuel blends, should be substantially straight chain 1-olefins such as 1-heptene, 1-octene, 1-nonene, 1-decene, and the like. Olefins of this type are known to exhibit excellent antiknock response to cyclopentadienyl manganese tricarbonyls—see Brown and Lovell, *Industrial and Engineering Chemistry*, Volume 50, No. 10, October 1958, pages 1547–50.

The gasoline base stock blends with which the cyclopentadienyl manganese tricarbonyl additive is blended pursuant to this invention will generally contain about 40 to 90 volume % of saturates, up to 30 (and preferably less than 10 and more preferably less than 5) volume % olefins, and up to about 45 volume % aromatics. Preferred gasoline base stock blends for use in the practice of this invention are those containing no more than 40% by volume of aromatics, more preferably no more than 30% by volume of aromatics, still more preferably no more than 28% by volume of aromatics, and most preferably no more than 25% by volume of aromatics. Preferably, the overall fuel blend will contain no more than 1% by volume and most preferably no more than 0.8% by volume of benzene.

Particularly preferred unleaded gasolines produced and/or utilized in the practice of this invention not only meet the emission reactivity criteria of this invention, but in addition, are characterized by having (1) a maximum sulfur content of 300 ppm, (2) a maximum bromine number of 20, (3) a maximum aromatic content of 20% by volume, (4) a maximum content of benzene of 1% by volume, and (5) a minimum content of contained oxygen of 2% by weight in the form of at least one monoether or polyether, such gasoline having dissolved therein up to about 0.03 gram of manganese per gallon as methylcyclopentadienyl manganese tricarbonyl. Gasolines of this type not containing the manganese additive are sometimes referred to as reformulated gasolines. See for example *Oil & Gas Journal*, Apr. 9, 1990, pages 43–48.

From the standpoint of octane quality, the preferred gasoline base stock blends are those having an octane rating of (R+M)/2 ranging from 78–95.

Any of a variety of cyclopentadienyl manganese tricarbonyl compounds can be used in the practice of this invention. Reference may be had, for example, to U.S. Pat. No. 2,818,417, all disclosure of which is incorporated herein by reference, for a description of suitable cyclopentadienyl manganese tricarbonyl compounds and their preparation. Illustrative examples of the manganese compounds which can be utilized in accordance with this invention include cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tert-butylcyclopentadienyl manganese tricarbonyl, octylcyclopentadienyl manganese tricarbonyl, dodecylcyclo-pentadienyl manganese tricarbonyl, ethylmethylcyclopentadienyl manganese tricarbonyl, indenyl manganese tricarbonyl, and the like, including mixtures of two or more such compounds. Generally speaking, the preferred compounds or mixtures of compounds are those which are in the liquid state of aggregation at ordinary ambient temperatures, such as methylcyclopentadienyl manganese tricarbonyl, ethylcyclopentadienyl manganese tricarbonyl, liquid mixtures of cyclopentadienyl manganese tricarbonyl and methylcyclopentadienyl manganese tricarbonyl, mixtures of methylcyclopentadienyl manganese tricarbonyl and ethylcyclopentadienyl manganese tricarbonyl, etc. The most preferred compound because of its commercial availability and its excellent combination of properties and effectiveness is methylcyclopentadienyl manganese tricarbonyl.

In order to satisfy the reduced emission reactivity criteria pursuant to this invention, the maximum reactivity of the $C_1$–$C_{10}$ hydrocarbon species emitted from an operating engine is determined utilizing the ozone reactivity values developed by William P. L. Carter of the Air Pollution Research Center, University of California, at Riverside, Calif.

Figure 2:
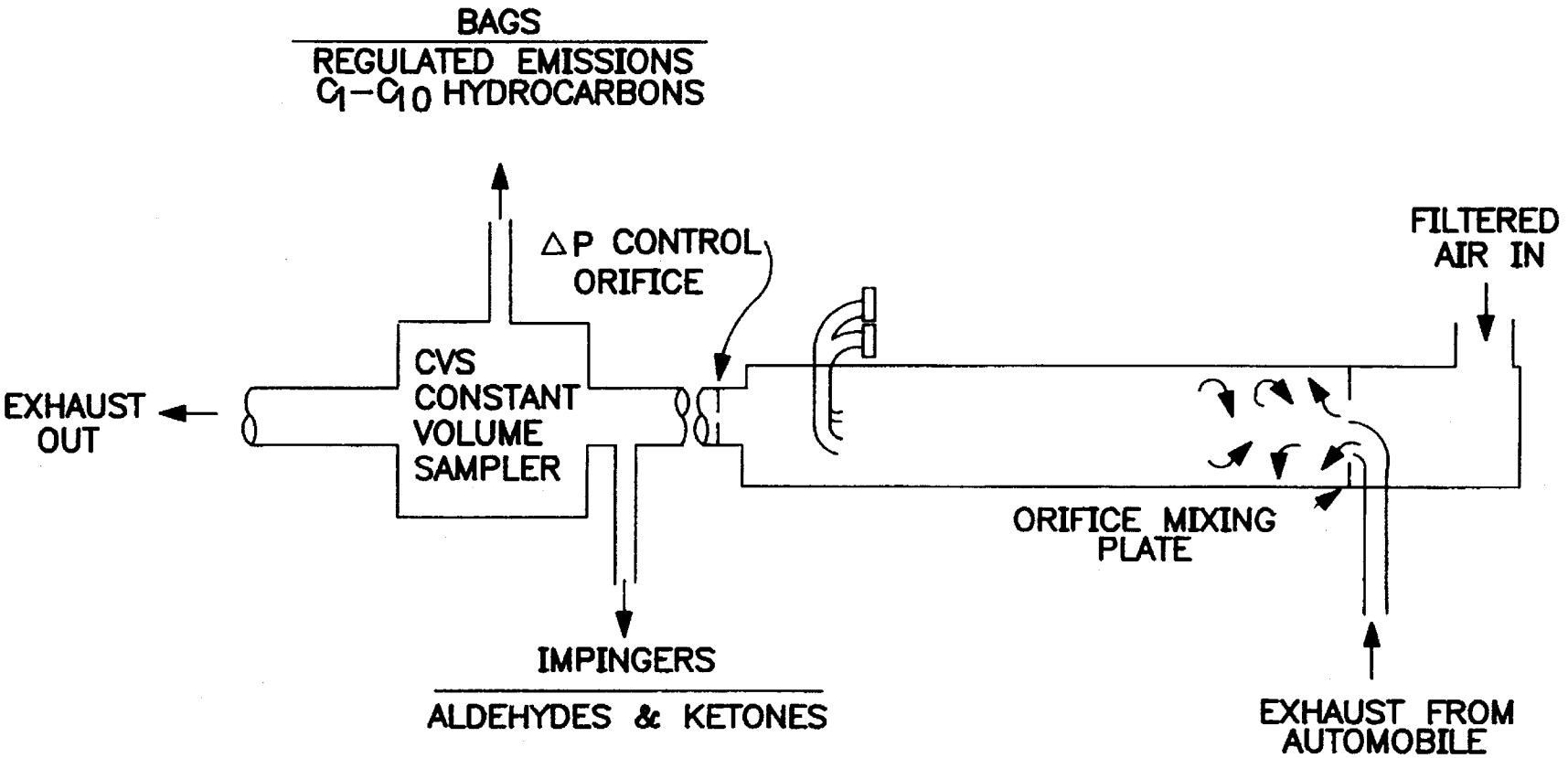
FIG. 2 is a schematic representation of the vehicle emissions sampling system utilized in the tests described in Examples 1–4 hereinafter.

In the case of motor vehicles, the methodology involves operating the vehicle on a chassis dynamometer (e.g., a Clayton Model ECE-50 with a direct-drive variable-intertia flywheel system which simulates equivalent weight of vehicles from 1000 to 8875 pounds in 125-pound increments) in accordance with the Federal Test Procedure (United States Code of Federal Regulations, Title 40, Part 86, Subparts A and B, sections applicable to light-duty gasoline vehicles). As schematically depicted in FIGS. 1 and 2, the exhaust from the vehicle is passed into a stainless steel dilution tunnel wherein it is mixed with filtered air. Samples of regulated emissions and samples for speciation of $C_1$–$C_{10}$ hydrocarbons are sampled from the diluted exhaust by means of a constant volume sampler (CVS) and are collected in bags (e.g., bags made from Tedlar resin) in the customary fashion.

The Federal Test Procedure utilizes an urban dynamometer driving schedule which is 1372 seconds in duration. This schedule, in turn, is divided into two segments; a first segment of 505 seconds (a transient phase) and a second segment of 867 seconds (a stabilized phase). The procedure calls for a cold-start 505 segment and stabilized 867 segment, followed by a ten-minute soak then a hot-start 505 segment. In the methodology used herein, separate samples for regulated emissions and for $C_1$–$C_{10}$ hydrocarbon speciation are collected during the cold-start 505 segment, the stabilized 867 segment, and the hot-start 505 segment.

If it is desired to collect and analyze exhaust samples for aldehydes and ketones, the sampling system will include an impinger collection system (note FIG. 2) enabling collection of exhaust samples continuously during the desired test cycles. The air-diluted exhaust is bubbled at a rate of four liters per minute through chilled glass impingers containing an acetonitrile solution of 2,4-dinitrophenylhydrazine and perchloric acid.

When collecting aldehyde and ketone samples, the Federal Test Procedure cycle is extended to include a four-cycle procedure for sampling the aldehydes and ketones. Thus the sampling schedule when sampling for (a) regulated emissions, (b) hydro-carbon speciation, and (c) aldehydes and ketones involves collecting samples for (a) during the cold-start 505 segment, the stabilized 867 segment, and the hot-start 505 segment. Samples for (b) are also separately collected during these three segments. However a sample for (c) is collected continuously during the cold-start 505 segment plus the stabilized 867 segment, and another sampling is started at the beginning of the hot-start 505 segment and is extended through the ensuing stabilized 867 segment. If it is only desired to sample for (a) and for (b), the impinger system and sampling procedure associated therewith are not used.

The analytical procedures used to conduct the hydrocarbon speciation are described in Example 1 hereinafter. To analyze for aldehydes and ketones, a portion of the acetonitrile solution is injected into a liquid chromatograph equipped with a UV detector. External standards of the aldehyde and ketone derivatives of 2,4-dinitrophenylhydrazine are used to quantify the results. Detection limits for this procedure are on the order of 0.005 ppm aldehyde or ketone in dilute exhaust.

To determine the total maximum reactivity of the speciated hydrocarbons, the value in terms of mg/mile for each speciated hydrocarbon is multiplied by the reactivity constant as developed by William P. L. Carter. These constants, which represent reactivity in terms of grams of ozone/gram of speciated hydrocarbon, as estimated by Carter, are set forth in Table 1.

TABLE 1

| Hydrocarbon | Reactivity, g Ozone/g Hydrocarbon |
|---|---|
| Methane | 0.0102 |
| Ethane | 0.147 |
| Propane | 0.33 |
| n-Butane | 0.64 |
| n-Pentane | 0.64 |
| n-Hexane | 0.61 |
| n-Heptane | 0.48 |
| n-Octane | 0.41 |
| n-Nonane | 0.29 |

TABLE 1-continued

| Hydrocarbon | Reactivity, g Ozone/g Hydrocarbon |
|---|---|
| n-Decane | 0.25 |
| Isobutane | 0.85 |
| Lumped C4–C5 Alkanes | 0.78 |
| Branched C5 Alkanes | 0.88 |
| Isopentane | 0.88 |
| Neopentane | 0.19 |
| 2-Methylpentane | 0.91 |
| 3-Methylpentane | 0.95 |
| Branched C6 alkanes | 0.91 |
| 2,3-Dimethylbutane | 0.74 |
| 2,2-Dimethylbutane | 0.41 |
| Lumped C6+ alkanes | 0.7 |
| 2,4-Dimethylpentane | 1.07 |
| 3-Methylhexane | 0.85 |
| 4-Methylhexane | 0.85 |
| Branched C7 alkanes | 0.85 |
| 2,3-Dimethylpentane | 0.96 |
| Isooctane | 0.7 |
| 4-Methylheptane | 0.72 |
| Branched C8 Alkanes | 0.72 |
| Branched C9 Alkanes | 0.68 |
| 4-Ethylheptane | 0.68 |
| Branched C10 Alkanes | 0.6 |
| 3 or 4-Propylheptane | 0.6 |
| Cyclopentane | 1.6 |
| Methylcyclopentane | 1.7 |
| C6 Cycloalkanes | 0.84 |
| Cyclohexane | 0.84 |
| C7 Cycloalkanes | 1.1 |
| Methylcyclohexane | 1.17 |
| Ethylcyclohexane | 1.36 |
| C8 Cycloalkanes | 1.36 |
| C9 Cycloalkanes | 1.6 |
| C10 Cycloalkanes | 1.31 |
| Ethene | 5.3 |
| Propene | 6.6 |
| 1-Butene | 6.1 |
| 1-Pentene | 4.2 |
| 3-Methyl-1-Butene | 4.2 |
| 1-Hexene | 3 |
| C6-Terminal Alkenes | 3 |
| C7-Terminal Alkenes | 2.4 |
| C8-Terminal Alkenes | 1.9 |
| C9-Terminal Alkenes | 1.6 |
| C10-Terminal Alkenes | 1.32 |
| Isobutene | 4.2 |
| 2-Methyl-1-Butene | 3.7 |
| Trans-2-Butene | 7.3 |
| Cis-2-Butene | 7.3 |
| 2-Methyl-2-Butene | 5 |
| C5-Internal Alkenes | 6.2 |
| 2,3-Dimethyl-2-Butene | 3.7 |
| C6-Internal Alkenes | 5.3 |
| C7-Internal Alkenes | 4.4 |
| C8-Internal Alkenes | 3.6 |
| C9-Internal Alkenes | 3.2 |
| C10-Internal Alkenes | 2.8 |
| 1,3-Butadiene | 7.7 |
| Isoprene | 6.5 |
| Cyclopentene | 4 |
| Cyclohexene | 3.3 |
| α-Pinene | 1.9 |
| β-Pinene | 1.9 |
| Benzene | 0.28 |
| Toluene | 1. |
| Ethylbenzene | 1.8 |
| n-Propylbenzene | 1.44 |
| Isopropylbenzene | 1.5 |
| Sec-Butylbenzene | 1.29 |
| C10 Monoalkylbenzenes | 1.28 |
| Meta-Xylene | 6 |
| Ortho-Xylene | 5.2 |
| Para-Xylene | 5.2 |
| C9 Dialkylbenzenes | 5.3 |
| C10 Dialkylbenzenes | 4.8 |
| 1,3,5-Trimethylbenzene | 7.5 |
| 1,2,3-Trimethylbenzene | 7.4 |

TABLE 1-continued

| Hydrocarbon | Reactivity, g Ozone/g Hydrocarbon |
|---|---|
| 1,2,4-Trimethylbenzene | 7.4 |
| C10 Trialkylbenzenes | 6.7 |
| Tetralin | 0.73 |
| Naphthalene | 0.87 |
| Acetylene | 0.37 |

The practice of this invention and the advantageous results achievable by its practice are illustrated in Examples 1–6 below. These examples are not intended to limit, and should not be construed as limiting, this invention.

EXAMPLE 1

Two 1988 Ford Crown Victoria 4-door sedans of essentially equal mileage (66,578 and 67,096) were operated under the same test conditions on chassis dynamometers using dynamometer settings of 4000 lbs inertia, and road load of 11.4 hp at 50 mph. For this pair of comparative tests, a commercially-available unleaded gasoline was procured and divided into two batches. Into one batch was blended methylcyclopentadienyl manganese tricarbonyl (MMT) in an amount equivalent to approximately 0.03 gram of manganese per gallon and the octane number, viz. (R+M)/2, of the resultant fuel ("MMT Fuel") was determined. Xylenes were blended into the other batch of the base gasoline in the amount necessary to match the octane number of the MMT-containing fuel. In addition n-butane was added to the latter fuel ("XY Fuel") to match the Reid vapor pressure of the MMT Fuel. Inspection data for these two test fuels and for the base gasoline are summarized in Table 2, wherein "--" represents "not measured".

TABLE 2

| Inspection Data on Test Fuels | | | |
|---|---|---|---|
| | MMT Fuel | XY Fuel | Base Fuel |
| Gravity, °API (D 1298) | 58.8 | 56.9 | — |
| Specific Gravity, 60° F. | 0.7436 | 0.7511 | — |
| Distillation, °F. (D 86) | | | |
| IBP/5 | 78/97 | 77/95 | 95/— |
| 10/20 | 113/141 | 115/145 | 122/— |
| 30/40 | 171/195 | 177/203 | — |
| 50/60 | 215/229 | 221/236 | 218/— |
| 70/80 | 240/269 | 254/277 | — |
| 90/95 | 315/343 | 309/335 | 320/— |
| FBP | 391 | 386 | 391 |
| Recovery, Vol % | 99.0 | 99.0 | 99.0 |
| Reid Vapor Pressure, psi (D 323) | 8.95 | 9.05 | 9.2 |
| Hydrocarbon Type, Vol. % (D 1319) | | | |
| Aromatics | 32.6 | 37.0 | 28.6 |
| Olefins | 2.1 | 3.2 | 4.5 |
| Saturates | 65.3 | 59.8 | 66.9 |
| Octane | | | |
| Research (D 2699) | 97.9 | 97.9 | 97.2 |
| Motor (D 2700) | 87.9 | 87.8 | 87.3 |
| (R + M)/2 | 92.9 | 92.9 | 92.2 |

One of the vehicles was operated on the MMT Fuel whereas the other vehicle was operated on the XY Fuel. Before testing, each vehicle was operated over a 3-bag Federal Test Procedure (United States Code of Federal Regulations, Title 40, Part 86, Subparts A and B, sections applicable to light-duty gasoline vehicles) to measure regulated emissions. The vehicles were then evaluated in duplicate at two mileage accumulation points using the above-described extended version of the Federal Test Procedure in order to collect separate samples for (a) regulated emissions, (b) hydrocarbon speciation, and (c) aldehydes and ketones. Thus the test schedule used not only accommodated the procedure as specified in the Code of Federal Regulations, but also provided a four-cycle procedure for sampling of aldehydes and ketones. Exhaust emission rates for total hydrocarbons, carbon monoxide, and oxides of nitrogen were reported in grams/mile.

The constant volume sampler (CVS) used for the evaluations was employed in conjunction with an 18-inch diameter by 16-foot long stainless steel dilution tunnel (note FIG. 1) and was run at a nominal 320 scfm. This flow rate generally provided tunnel sampling zone temperatures not exceeding 110° F. during the Federal Test Procedures. A cooling fan of 5000 cfm capacity was used in front of the vehicle during all test cycles. The hood was maintained fully open during all cycles and was closed during the soak periods. Exhaust sampling was conducted employing a system used in accordance with the guidelines established in the studies reported in the following papers and reports:

Urban et al, "Regulated and Unregulated Exhaust Emissions from Malfunctioning Automobiles," Paper 790696, presented at the 1979 SAE Passenger Car Meeting, Dearborn, Mich., June 1979;

Urban et al, "Exhaust Emissions from Malfunctioning Three-way Catalyst-Equipped Automobiles." Paper 800511, presented at the 1980 SAE Congress and Exposition, Detroit, Mich., February, 1980;

Urban, "Regulated and Unregulated Exhaust Emissions from Malfunctioning Non-Catalyst and Oxidation Catalyst Gasoline Automobiles," EPA Report 460/3-80-003, 1980; and p1 Smith et al, "Characterization of Emissions from Motor Vehicles Designed for Low $NO_x$ Emissions," Final Report EPA 600/2-80-176 prepared under Contract No. 68-02-2497, July 1980.

Table 3 summarizes the hydrocarbon speciation procedures in these tests.

TABLE 3

Sampling & Analysis Methodology for Hydrocarbon Speciation

| Compounds | Collection | Analysis |
|---|---|---|
| $C_1$–$C_3$ hydrocarbons, benzene, toluene | Bag | GC-FID |
| $C_4$ hydrocarbons including 1,3-butadiene | Bag | GC-FID |
| $C_5$–$C_{10}$ hydrocarbons | Bag | GC with capillary column subambient capability-FID |

The analytical procedures used to conduct the hydrocarbon speciation for $C_1$ to $C_3$ plus benzene and toluene, and the $C_4$ (1,3-butadiene) procedure are described in detail in the following United States Environmental Protection Agency reports:

Smith et al, "Analytical Procedures Characterizing Unregulated Pollutant Emissions from Motor Vehicles," Report EPA 600/2-79-17, prepared under Contract No. 68-02-2497, February 1979; and Smith, "Butadiene Measurement Methodology," Final Report EPA 460/3-88-005, prepared under Work Assignment B-1 of Contract No. 68-03-4044, August, 1988.

The individual analytical procedures were as follows:

C1–C3 Hydrocarbons, Benzene, and Toluene

Dilute exhaust emissions were sampled in Tedlar bags and analyzed by gas chromatography (GC) with a flame ionization detector (FID). The compounds that were analyzed included methane, ethane, ethylene, acetylene, propane, propylene, benzene, and toluene. The GC system was equipped with four separate packed columns which are used to resolve the individual compounds. A system of timers, solenoid valves, and gas sampling valves direct the flow of the sample through the system. The carrier gas is helium. Peak areas are compared to an external calibration blend and the hydrocarbon concentrations are obtained using a Hewlett-Packard 3353 computer system. Minimum detection limits for $C_1$ to $C_3$ compounds, benzene, and toluene are 0.05. ppmC.

C4 Hydrocarbons Including 1,3-Butadiene

The procedure used provides separations and concentration data for seven $C_4$ compounds, namely: isobutane, butane, 1-butene, isobutene, cis-2-butene, trans-2-butene and 1,3-butadiene. Standard constant volume sampler (CVS) bag samples and evaporative emission bag samples were analyzed for the $C_4$ compounds using a GC equipped with an FID. The GC system utilized a Perkin-Elmer Model 3920B GC with an FID, two pneumatically-operated and electrically-controlled Seiscor valves, and an analytical column. This column is a 9 ft×⅛-in. stainless steel column containing 80/100 Carbopack C with 0.19% picric acid. The carrier gas is helium, which flows through the column at a rate of 27 mL/min. The column temperature is maintained at 40° C. for analysis. External standards in zero air are used to quantify the results. Detection limits for the procedure are on the order of 0.03 ppmC.

C5–C10 Hydrocarbons

This procedure permits the quantitative determination of more than 80 individual hydrocarbon species in automotive emissions. The GC system utilizes a Perkin-Elmer Model 3920B GC equipped with subambient capabilities, a capillary column, and an FID. The capillary column used in the system is a Perkin-Elmer F-50 Versilube, 150-ft×0.02-in. WCOT stainless steel column. The column is initially cooled to −139° F. (−95° C.) for sample injection. Upon injection, the temperature is programmed at a 7° F. (4°C.) increase per minute to 185° F. (85°C.). The column temperature is held at 185° F. for approximately 15 minutes to complete column flushing. A flow controller is used to maintain a 1.5 mL/min helium carrier flow rate. The 10 mL sample volume permits determination of 0.1 ppmC with the flame ionization detector.

Utilizing the maximum ozone reactivity data set forth in Table 1 above, the total maximum reactivity of the speciated hydrocarbons from each car was determined for both the 500 and the 1000 mileage accumulation points. Table 4 summarizes the total maximum reactivity data so determined.

TABLE 4

| Total Maximum Reactivities of Speciated Hydrocarbons | | | | |
|---|---|---|---|---|
| | 500 Miles | | 1000 Miles | |
| Octane Enhancer | FTP-HC* | Total Max. Reactivity | FTP-HC* | Total Max. Reactivity |
| 0.03 g Mn/gal as MMT** | 475 | 549 | 550 | 662 |
| Xylenes (XY) | 562 | 794 | 574 | 933 |
| Difference (XY minus MMT) | 87 | 245 | 24 | 271 |
| % Improvement with MMT | 15.5 | 31 | 4 | 29 |

*Federal Test Procedure Hydrocarbons, Milligrams per Mile
**Methylcyclopentadienyl Manganese Tricarbonyl The data in Table 4 show that in this fuel the methylcyclopentadienyl manganese tricarbonyl caused a reduction in total hydrocarbon emissions of 15.5% at 500 test miles and 4% at 1000 test miles. Of even greater importance is the fact that at both the 500 and the 1000 mileage accumulation points, the total maximum reactivity of the emitted hydrocarbons determined as described above was approximately 30% lower (31% and 29% lower) with the MMT-containing fuel than the total maximum reactivity of the emissions from the same fuel containing the added amount of xylenes needed to match the octane quality of the MMT-containing fuel.

EXAMPLE 2

The procedure of Example 1 was repeated using as the base fuel a commercially-available unleaded regular gasoline from a different domestic oil company. Table 5 summarizes the principal inspection data for the two test fuels blended therefrom—i.e., the MMT Fuel and the XY Fuel.

TABLE 5

| Inspection Data on Test Fuels | | |
|---|---|---|
| | MMT Fuel | XY Fuel |
| Gravity, °API (D 1298) | 62.6 | 61.0 |
| Specific Gravity, 60° F. | 0.7290 | 0.7351 |
| Distillation, °F. (D86) | | |
| IBP/5 | 79/98 | 77/92 |
| 10/20 | 110/129 | 105/125 |
| 30/40 | 148/171 | 150/180 |
| 50/60 | 199/231 | 211/240 |
| 70/80 | 261/296 | 266/292 |
| 90/95 | 340/370 | 327/353 |
| FBP | 410 | 405 |

TABLE 5-continued

| Inspection Data on Test Fuels | | |
|---|---|---|
| | MMT Fuel | XY Fuel |
| Recovery, Vol. % | 99.0 | 99.0 |
| Reid Vapor Pressure, psi (D323) | 10.55 | 10.50 |
| Hydrocarbon Type, Vol. % (D323) | | |
| Aromatics | 29.8 | 36.4 |
| Olefins | 4.9 | 5.5 |
| Saturates | 65.3 | 58.1 |
| Octane | | |
| Research (D2699) | 92.6 | 92.6 |
| Motor (D 2700) | 82.5 | 82.5 |
| (R + M)/2 | 87.6 | 87.6 |

The results of the comparative tests with these fuels are summarized in Table 6.

TABLE 6

| Total Maximum Reactivities of Speciated Hydrocarbons | | | | |
|---|---|---|---|---|
| Octane Enhancer | FTP-HC* | Total Max. Reactivity | FTP-HC* | Total Max. Reactivity |
| 0.03 g Mn/gal as MMT** | 510 | 705 | 478 | 597 |
| Xylenes (XY | 540 | 870 | 568 | 844 |
| Difference (XY – MMT) | 30 | 165 | 90 | 247 |
| % Improvement w/MMT | 5.5 | 19 | 15.8 | 29 |

*Federal Test Procedure Hydrocarbons, Milligrams per Mile
**Methylcyclopentadienyl Manganese Tricarbonyl The data in Table 6 show that in this fuel not only did the MMT reduce the total amount of emitted hydrocarbons by 5,5 and 15.8% as compared to the XY Fuel, but even more importantly, the total maximum reactivity of the speciated exhaust hydrocarbons from the MMT Fuel was 19 and 29% lower than the total maximum reactivity of the emissions from the same base fuel (Mn-free) containing the added amount of xylenes needed to match the octane quality of the MMT-containing fuel.

EXAMPLE 3

The procedure of Example 1 was again repeated, this time using a commercially-available unleaded regular gasoline from a different domestic oil company containing 1% by weight of contained oxygen in the form of an ether blending agent (believed to be methyl tert-butyl ether). The principal inspection data for the two test fuels blended from this base gasoline—i.e., the MMT Fuel and the XY Fuel—are summarized in Table 7.

TABLE 7

Inspection Data on Test Fuels

| | MMT Fuel | XY Fuel |
|---|---|---|
| Gravity, °API (D1298) | 59.3 | 58.7 |
| Specific Gravity, 60° F. | 0.7416 | 0.7440 |
| Distillation, °F. (D 86) | | |
| IBP/5 | 101/120 | 96/115 |
| 10/20 | 134/157 | 131/158 |
| 30/40 | 178/198 | 180–202 |
| 50/60 | 217/239 | 224/240 |
| 70/80 | 263/305 | 270/302 |
| 90/95 | 365/401 | 355/400 |
| FBP | 434 | 440 |
| Recovery, Vol. % | 99.0 | 99.0 |
| Reid Vapor Pressure, psi (D323) | 6.95 | 7.10 |
| Hydrocarbon Type, Vol. % (D1319) | | |
| Aromatics | 25.2 | 26.4 |
| Olefins | 4.2 | 5.0 |
| Saturates | 70.6 | 68.1 |
| Octane | | |
| Research (D 2699) | 93.0 | 93.0 |
| Motor (D 2700) | 83.8 | 84.0 |
| (R + M)/2 | 88.4 | 88.5 |

the results of this pair of tests.

TABLE 8

Total Maximum Reactivities of Speciated Hydrocarbons

| | 500 MILES | | 1,000 Miles | |
|---|---|---|---|---|
| Octane Enhancer | FTP-HC* | Total Max. Reactivity | FTP-HC* | Total Max. Reactivity |
| 0.03 g Mn/gal as MMT** | 530 | 600 | 605 | 689 |
| Xylenes (XY) | 536 | 796 | 590 | 876 |
| Difference (XY – MMT) | 6 | 196 | (15) | 187 |
| % Improvement with MMT | 1 | 25 | (2.5) | 21 |

*Federal Test Procedure Hydrocarbons, Milligrams per Mile
**Methylcyclopentadienyl Manganese Tricarbonyl The data in Table 8 show that in this fuel the total maximum reactivity of the speciated exhaust hydrocarbons from the MMT Fuel was approximately 23% lower (25 and 21% lower) than the total maximum reactivity of the emissions from the same base fuel (Mn-free) containing the added amount of xylenes needed to match the octane quality of the MMT-containing fuel. Thus even though the total amount of emitted hydrocarbons was about equal for the two test fuels, the MMT fuel of this invention produced a substantially less reactive hydrocarbon exhaust and as a consequence, had a lower ground level ozone forming potential.

Overall, the vehicle operated on the MMT Fuels emitted lower levels of hydrocarbons, carbon monoxide, and oxides of nitrogen than did the vehicle operated under the same test conditions on the XY Fuels. And as set forth in detail above, the total maximum reactivities of the hydrocarbons emitted by the vehicle using the MMT Fuels was substantially lower than the total maximum reactivities of the hydrocarbons emitted by the vehicle which used the XY Fuels. It was also observed from the tests conducted as per Examples 1–3 above that the vehicle operated on the MMT Fuel generally produced lower emissions of aldehydes such as formaldehyde, acetaldehyde, and benzaldehyde than the vehicle operated on the XY Fuels. Fuel economies were slightly lower (1–2%) for the MMT-fueled vehicle.

EXAMPLE 4

Using the procedure of Example 1, a comparison was made as between the maximum total reactivity of the speciated hydrocarbons from the MMT Fuel of Example 1 and the same base fuel with which no additional xylenes or other aromatics were added. In short, this evaluation compared the base fuel of Example 1 with the identical base fuel containing MMT at a concentration of about 0.03 gram of manganese per gallon. Table 9 presents the averaged results obtained in these runs.

TABLE 9

Total Maximum Reactivities of Speciated Hydrocarbons

| Octane Enhancer | FTP-HC* | Total Max. Reactivity |
|---|---|---|
| 0.03 g Mn/gal as MMT** | 512.6 | 606 |
| None (Base Fuel) | 595.0 | 845 |
| Difference (None – MMT) | 82.4 | 239 |
| % Improvement with MMT | 14 | 28 |

*Federal Test Procedure Hydrocarbons, Milligrams per Mile
**Methylcyclopentadienyl Manganese Tricarbonyl It can be seen from the data in Table 9 that the MMT Fuel of this invention not only produced less total hydrocarbon tailpipe emissions but even more importantly, the total maximum reactivity of the speciated hydrocarbon emissions from the MMT-fuel vehicle was as substantially lower (28% lower) than the speciated hydro-carbon emissions from the clear (manganese-free) base fuel. Note also from Table 2 that the octane quality of the MMT Fuel was significantly higher than that of the clear base fuel, i.e., (R+M)/2 of 92.9 v. 92.2.

The following examples illustrate the practices and advantages of this invention using reformulated gasolines and gasolines containing oxygenates. These examples are not intended to limit, and should not be construed as limiting, this invention.

For purposes of this invention, a gasoline is considered reformulated if it results in no increase in oxides of nitrogen ($NO_x$), contains no more than 1 volume percent benzene, contains at least 2.0% oxygen by weight, contains no heavy metals unless waived by the EPA, and meets or is below a Reid Vapor Pressure (RVP) of about 8.2 psi or less. In addition, the gasoline must meet the EPA's toxic performance standards considering its benzene, oxygenate, and aromatic content.

EXAMPLE 5

Two 1988 model 5.0 liter Crown Victoria 4-door sedans of essentially equal mileage (about 65,000 miles) were operated under the same test conditions as in Example 1 on Howell EEE fuel. One car was run on Howell EEE fuel containing methylcyclopentadienyl manganese tricarbonyl (MMT) in an amount equivalent to approximately 0.03 gram of manganese per gallon and the octane number viz.(R+M)/2 of the resultant fuel ("MMT fuel") was determined. For these tests, three sets of fuels were blended. The first was Howell EEE - which was divided into two batches, one of which was treated with MMT additive, while xylenes were added to the other batch to obtain an octane number about equal to that of the first batch. The second set of fuels was a regular commercial grade, all hydrocarbon fuel. Again, the fuel was divided and half was treated with MMT additive while the other half was treated with xylenes. For the third set of fuels, a commercial reformulated gasoline containing about 5% methyl tert butyl ethers (MTBE) was divided into two batches, which were treated similarly: one batch with xylenes, and one batch with MMT additive. Results of emission testing are shown in Table 10.

TABLE 10

| | Howell EEE with | | Commercial Fuel with | | Reformulated Gasoline with | |
|---|---|---|---|---|---|---|
| | Xylene (mg/mile) | MMT (mg/mile) | Xylene (mg/mile) | MMT (mg/mile) | Xylene (mg/mile) | MMT (mg/mile) |
| HC | 568 | 513 | 554 | 494 | 563 | 567 |
| Non Methane HC | 448 | 387 | 442 | 362 | 415 | 407 |
| Aromatics | 90 | 51 | 66 | 40 | 51 | 28 |
| $NO_x$ | 1,373 | 940 | 1,200 | 862 | 1,406 | 982 |
| CO | 2,208 | 1,380 | 2,377 | 1,496 | 2,472 | 1,607 |
| Alkenes ($C_2$–$C_6$) | 47 | 39 | 51 | 45 | 73 | 63 |
| Benzene | 16 | 11 | 11 | 7 | 9 | 8 |
| Formaldehyde | 6 | 5 | 7 | 5 | 7 | 6 |
| 1,3 Butadiene | 0.7 | 0.5 | 1.1 | 1.0 | 1.2 | 1.1 |
| Acetaldehyde | 2.1 | 1.7 | 2.4 | 1.8 | 1.7 | 1.4 |
| Toxic Aggregate | 24.8 | 18.2 | 21.5 | 14.8 | 18.9 | 16.5 |
| Reactivities[1] | 863 | 605 | 857 | 651 | 836 | 644 |

[1]Reactivity is the sum of the products of each hydrocarbon species multiplied by WLP Carter's maximum reactivity factors.

EXAMPLE 6

In another series of tests performed generally in accordance with the test procedures of Example 1, four sets of fuels were used. The initial set of fuels was Howell EEE, with and without MMT additive wherein the octane numbers were not the same. The second set of fuels was blended using all hydrocarbon stocks, similar to the Industry Average Fuel (IAF). One blend contained the MMT additive and the other did not, however both fuels were designed to be equal in octane rating (about 88 (R+M)/2). A third set of fuels was blended in the same manner containing about 11% methyl tert butyl ether (MTBE) with and without MMT additive. The final set of fuels was blended using 10% ethanol with and without MMT additive. The fuel specifications are given in Table 11.

TABLE 11

| | HOWELL EEE | IND. AVG. FUEL | | FUEL PLUS MTBE | | EtOH FUEL | |
|---|---|---|---|---|---|---|---|
| | No MMT | No MMT | w/MMT | No MMT | w/MMT | No MMT | w/MMT |
| MTBE (v %) | — | — | — | 10.8 | 19.7 | — | — |
| Ethanol (v %) | — | — | — | — | — | 10.1 | 10.5 |
| Sulfur (v %) | — | 0.029 | 0.017 | 0.0107 | 0.0078 | 0.005 | 0.0225 |
| Reid Vapor Pressure | 9.2 | 8.7 | 8.4 | 8.9 | 8.6 | 8.4 | 8.5 |
| Benzenes (v %) | — | 0.94 | 1.1 | 0.83 | 1.05 | 0.092 | 1.03 |

TABLE 11-continued

| | HOWELL EEE | IND. AVG. FUEL | | FUEL PLUS MTBE | | EtOH FUEL | |
|---|---|---|---|---|---|---|---|
| | No MMT | No MMT | w/MMT | No MMT | w/MMT | No MMT | w/MMT |
| Distillation (°F.) | | | | | | | |
| 10% | 122 | 137 | 136 | 135 | 134 | 129 | 125 |
| 50% | 218 | 222 | 209 | 174 | 172 | 156 | 147 |
| 90% | 320 | 351 | 304 | 303 | 283 | 312 | 274 |
| Aromatics (v %) | 28.6 | 33.7 | 30.1 | 35.8 | 30.2 | 29.8 | 24.0 |
| Olefins (v %) | 4.5 | 4.4 | 7.2 | 4.1 | 3.2 | 4.5 | 5.8 |
| Saturates (v %) | 66.9 | 61.9 | 62.7 | 60.1 | 66.6 | 65.7 | 70.2 |
| OCTANE | | | | | | | |
| Research (D 2699) | 97.2 | 92.5 | 91.5 | 93.2 | 92.5 | 94.5 | 93.3 |
| Motor (D 2700) | 87.3 | 84.5 | 83.5 | 85.4 | 84.7 | 86.0 | 89.2 |
| Index | 92.2 | 88.5 | 87.5 | 89.3 | 88.6 | 90.2 | 89.2 |

Data on emissions are given in Table 12 for each fuel. The cars selected for each set of fuels were a 2.0L Chevrolet Cavalier, a 2.5L Buick, a 3.8L Buick, and a 5.L Crown Victoria—all of which had accumulated about 75,000 miles prior to the test.

TABLE 12

| | HOWELL EEE | | IAF | | MTBE | | ETHANOL | |
|---|---|---|---|---|---|---|---|---|
| | No MMT | Plus MMT | No MMT | Plus MMT | No MMT | Plus MMT | No MMT | Plus MMT |
| HC (mg/mile) | 330 | 320 | 320 | 300 | 270 | 240 | 290 | 270 |
| CO (mg/mile) | 2,750 | 2,780 | 3,060 | 2,490 | 2,760 | 2,320 | 2,380 | 2,080 |
| $NO_x$ (mg/mile) | 610 | 540 | 660 | 520 | 660 | 480 | 780 | 500 |
| Net HC (mg/mile) | — | — | 234 | 217 | 222 | 181 | — | — |
| Ozone Reactivity (mg/mile) | — | — | 530 | 432 | 432 | 354 | — | — |
| Benzene (mg/mile) | 8.1 | 9.4 | 14.7 | 11.4 | 8.6 | 7.2 | 10.3 | 8.7 |
| 1,3-butadiene (mg/mile) | 0.5 | 0.5 | 0.7 | 0.7 | 0.5 | 0.4 | 0.7 | 0.6 |
| Formaldehyde (mg/mile) | 3.6 | 3.3 | 2.7 | 2.4 | 4.2 | 2.6 | 3.0 | 2.5 |
| Acetaldehyde (mg/mile) | 1.1 | 1.4 | 1.2 | 1.1 | 1.1 | 0.8 | 3.4 | 3.1 |
| TOTAL TOXICS (mg/mile) | 13.3 | 14.6 | 19.3 | 15.6 | 14.4 | 11.0 | 17.4 | 14.9 |

The fuels of this invention can contain one or more other additives provided such other additive or combination of additives does not excessively detract from the performance—especially the improved exhaust emission performance such as is illustrated by Examples 1–6 —exhibited by the same base fuel containing up to about 0.03 of a gram of manganese per gallon when devoid of such other additive or additives. Antioxidants, deposit-control additives (e.g., induction system cleanliness additives, carburetor detergents, ORI-control additives, etc.), corrosion inhibitors, metal deactivators, and oxygenated blending materials such as dihydrocarbyl ethers and polyethers, typify additives commonly utilized in gasolines, and which may be used in the fuels of this invention subject to the foregoing proviso. In short, this invention contemplates the inclusion in the fuel of any ancillary additive or combination of additives which contributes an improvement to the fuel or its performance and which does not destroy or seriously impair the performance benefits made possible by this invention.

Preferred oxygenated materials that can be blended into the fuels of this invention are ethers of suitable low volatility such as methyl tert-butyl ether, ethyl tert-butyl ether, tert-amyl methyl ether, 2,2-diethyl-1,3-propanediol, and the like. In addition, mixtures of methyl hydrocarbyl ethers formed by catalytic methoxylation of olefin components in gasoline can be effectively utilized. Processes for producing such mixtures are known and reported in the literature. See for example U.S. Pat. No. 4,746,761, and WO 8911463, and references cited therein. Also useful are fuel-soluble esters and alcohols of suitably low volatility such as tert-butyl acetate, 1-hexanol, 2-hexanol, 3-hexanol, polyethoxyethanols, and the like. Usually such oxygenated compounds are employed in amounts sufficient to provide up to 3 to 4 weight % oxygen in the fuel, provided such usage is consistent with existing or proposed legislation. Other suitable oxygen-containing blending agents include p-cresol, 2,4-xylene, 3-methoxyphenol, 2-methylfuran, cyclopentanone, isovaleraldehyde, 2,4-pentanedione and similar oxygen-containing substances.

Preferred antioxidants for the fuels of this invention are hindered phenolic antioxidants, such as 2,6-di-tert-butylphenol, 2,4-dimethyl-6-tert-butylphenol, 4-methyl-2,6-di-tert-butyl-phenol, 4-ethyl-2,6-di-tert-butylphenol, 4-butyl-2,6-di-tert-butylphenol, and mixtures of tertiary butylated phenols predominating in 2,6-di-tert-butylphenol. In some cases aromatic amine antioxidants can prove useful either alone or in combination with a phenolic antioxidant. Antioxidants are usually employed in amounts of up to 25 pounds per thousand barrels, the amount used in any given case being dependent upon the stability (e.g., olefin content) of the gasoline.

Another type of additives preferably utilized in the fuels of this invention are ashless detergents such as polyether amines, polyalkenyl amines, alkenyl succinimides, polyether amide amines, and the like. Such materials can be used at treat levels of 50 to 500 pounds per thousand barrels, and more usually in the range of 100 to 200 pounds per thousand barrels.

The cyclopentadienyl manganese tricarbonyl compounds as well as the other supplemental additives or blending agents can be blended with the base fuels according to well known procedures utilizing conventional mixing equipment. This invention is directed to all such fuel compositions meeting the primary requisites of this invention.

This invention is susceptible to considerable variation in its practice within the spirit and scope of the appended claims, the forms hereinabove described constituting preferred embodiments thereof. Thus this invention is not intended to be limited by the specific exemplifications set forth herein.

What is claimed is:

1. A method of reducing atmospheric pollution which comprises:

a) operating a refinery having a rated crude capacity of more than about 50,000 barrels per stream day, and utilizing in said operation at least 50% of the rated capacity in producing gasoline hydrocarbons, said refinery including at least one reformer operation having a furnace operated on fuel oil;

b) forming a finished gasoline fuel having a target octane number by (1) blending together gasoline hydrocarbon blending components of the gasoline boiling range comprising saturates, olefins and aromatics to form a base fuel, and (2) including in said base fuel at least one cyclopentadienyl manganese tricarbonyl compound in an amount equivalent to up to about 0.03 gram of manganese per gallon to form a finished gasoline fuel, with the proviso that in achieving the target octane number of said finished gasoline fuel, the amounts of said olefins and said aromatics are minimized and the consequent loss of octane quality resulting from such minimization is compensated for by said inclusion of said at least one cyclopentadienyl manganese tricarbonyl compound;

c) conducting said reformer operation under conditions of reduced severity in producing aromatics for said base fuel and decreasing the amount of atmospheric emissions from the combustion of said fuel oil in said furnace; and d) delivering said finished gasoline fuel for use as fuel to operate spark ignition internal combustion engines so that combustion of said gasoline fuel in the engines yields tail-pipe exhaust products in which (1) the maximum reactivity of said exhaust products produced by said combustion is reduced, (2) the amount of potential smog-forming components released into the atmosphere in said exhaust products is reduced, and (3) at least the content of $NO_x$ in the said exhaust products is also reduced.

2. A method according to claim 1 wherein in forming said finished gasoline fuel having said target octane number, the amount of aromatics used in said finished gasoline fuel is reduced by at least 4.55 volume percent.

3. A method according to claim 1 wherein in forming said finished gasoline fuel having said target octane number, the amount of aromatics used in said finished gasoline fuel is reduced by at least 11.89 volume percent.

4. A method according to claim 1 wherein in forming said finished gasoline fuel having said target octane number, the Reid vapor pressure of said finished gasoline is reduced.

5. A method according to claim 1 wherein in forming said finished gasoline fuel having said target octane number, the amount of aromatics used in said finished gasoline fuel is reduced by at least 4.55 volume percent, and wherein the Reid vapor pressure of said finished gasoline is reduced by at least 1.1%.

6. A method according to claim 1 wherein in forming said finished gasoline fuel having said target octane number, the amount of benzene therein is maintained at less than 1% by volume.

7. A method according to claim 6 wherein said amount of benzene is no more than 0.8% by volume.

8. A method according to claim 1 wherein in forming said finished gasoline fuel having said target octane number, at least one oxygenated fuel blending component is blended therein.

9. A method of operating a refinery to reduce atmospheric pollution, said refinery having (1) a rated crude capacity of more than about 50,000 barrels per stream day and (2) at least one reformer operation which includes a furnace operated on fuel oil, which method comprises:

a) operating said refinery so that at least 50% of the rated capacity thereof is utilized in producing gasoline hydrocarbons;

b) reducing the amount of crude oil used in said refinery in producing gasoline hydrocarbons by at least about 0.5% based on the total crude capacity of said refinery;

c) reducing the severity of said reformer operation in producing aromatics for use in the formulation of gasoline and concurrently reducing the amount of fuel oil fed to each furnace used in the reformer operation thereby decreasing the amount of atmospheric emissions from the combustion of said fuel oil in said furnace;

d) forming a finished gasoline fuel having a target octane number by (1) blending together gasoline hydrocarbon blending components of the gasoline boiling range comprising (a) saturates, (b) olefins and (c) aromatics formed in said reformer operation to form a base fuel, and in conducting said blending, minimizing the proportions of olefins and aromatics used in said base fuel so that the resultant base fuel has an octane number below said target octane number and (2) including in said base fuel at least one cyclopentadienyl manganese tricarbonyl compound in an amount equivalent to up to about 0.03 gram of manganese per gallon sufficient to convert said base fuel into a finished gasoline fuel having said target octane number; and e) delivering said finished gasoline fuel for use as fuel to operate spark ignition internal combustion engines so that combustion of said gasoline fuel in the engines yields tail-pipe exhaust products in which (1) the maximum reactivity of said exhaust products produced by said combustion is reduced, (2) the amount of potential smog-forming components released into the atmosphere in said exhaust products is reduced, and (3)

at least the content of $NO_x$ in the said exhaust products is also reduced.

10. A method according to claim 9 wherein in forming said finished gasoline fuel having said target octane number, the amount of aromatics used in said finished gasoline fuel is reduced by at least 4.55 volume percent.

11. A method according to claim 9 wherein in forming said finished gasoline fuel having said target octane number, the amount of aromatics used in said finished gasoline fuel is reduced by at least 11.89 volume percent.

12. A method according to claim 9 wherein in forming said finished gasoline fuel having said target octane number, the Reid vapor pressure of said finished gasoline is reduced.

13. A method according to claim 9 wherein in forming said finished gasoline fuel having said target octane number, the amount of aromatics used in said finished gasoline fuel is reduced by at least 4.55 volume percent, and wherein the Reid vapor pressure of said finished gasoline is reduced by at least 1.1%.

14. A method according to claim 9 wherein in forming said finished gasoline fuel having said target octane number, the amount of benzene therein is maintained at less than 1% by volume.

15. A method according to claim 14 wherein said amount of benzene is no more than 0.8% by volume.

16. A method according to claim 9 wherein in forming said finished gasoline fuel having said target octane number, at least one oxygenated fuel blending component is blended therein.

* * * * *

UNITED STATES PATENT AND TRADEMARK OFFICE

CERTIFICATE OF CORRECTION

PATENT NO. : 5,599,357

DATED : February 4, 1997

INVENTOR(S) : Thomas A. Leeper

It is certified that error appears in the above-indentified patent and that said Letters Patent is hereby corrected as shown below:

On title page, item [73] Assignee: Ehtyl Corporation... should read as follows:

[73] Assignee: Ethyl Corporation...

Signed and Sealed this

Twenty-fourth Day of June, 1997

Bruce Lehman

*Attest:*

BRUCE LEHMAN

*Attesting Officer*

*Commissioner of Patents and Trademarks*